United States Patent [19]

Lucius et al.

[11] 4,343,528

[45] * Aug. 10, 1982

[54] MODULAR INTERCONNECT SYSTEM

[75] Inventors: John E. Lucius, Harrisburg; Leon T. Ritchie, Mechanicsburg, both of Pa.

[73] Assignee: AMP Incorporated, Harrisburg, Pa.

[ * ] Notice: The portion of the term of this patent subsequent to Jan. 6, 1998, has been disclaimed.

[21] Appl. No.: 143,708

[22] Filed: Apr. 25, 1980

[51] Int. Cl.[3] ..... H01R 9/00; H01R 13/50

[52] U.S. Cl. ..... 339/198 G; 339/206 R

[58] Field of Search ..... 339/97 R, 97 P, 98, 339/99 R, 198, 206, 207, 209, 210

[56] References Cited

U.S. PATENT DOCUMENTS

| | | | |
|---|---|---|---|
| 3,273,107 | 9/1966 | Chandler | 339/198 S |
| 3,363,224 | 1/1968 | Gluntz | 339/258 |
| 3,966,293 | 6/1976 | Mathe et al. | 339/103 R |
| 4,032,215 | 6/1977 | Jarmofsky et al. | 339/258 R |
| 4,035,049 | 7/1977 | McKee | 339/97 R |
| 4,095,870 | 6/1978 | Mathe | 339/103 R |
| 4,243,288 | 1/1981 | Lucius et al. | 339/206 X |

*Primary Examiner*—Joseph H. McGlynn
*Assistant Examiner*—Frank H. McKenzie, Jr.
*Attorney, Agent, or Firm*—Russell J. Egan

[57] ABSTRACT

An interconnect system is disclosed which enables the interconnection of a plurality of modules, each terminating a different cable, in a single connector. Each module can be used to terminate an individual cable and an assembly of modules are secured together in a single interconnect housing. Thus it is possible, with this connector, to intermix cables of different types such as ribbon cable, jacketed cable, etc., as well as cables of different numbers of conductors and cables having different wire sizes and wire types, for example stranded or solid conductor.

6 Claims, 4 Drawing Figures

MODULAR INTERCONNECT SYSTEM

CROSS REFERENCE TO RELATED APPLICATIONS

The present invention utilizes the terminal described in our application Ser. No. 927,720 filed July 25, 1978 and is an improvement over the connector described in our application Ser. No. 53,150 filed June 28, 1979 now U.S. Pat. No. 4,243,288, both disclosures being incorporated herein by reference.

BACKGROUND OF THE INVENTION

1. The Field of the Invention

The present invention relates to a modular interconnect system and in particular to an interconnect system which can be used in a wide variety of cable types, styles, and conductor number and type.

2. The Prior Art

Mass termination, which is the ability to simultaneously terminate multiple conductors without stripping the insulation, has had a significant impact on connector design in recent years. Compared to more conventional termination methods, the mass termination systems offer numerous advantages. The greatest advantage is time saving. In view of the ever increasing cost of labor, any reduction in termination time can result in a significant manufacturing saving. A further advantage is that mass termination reduces to a minimum contact damage since the termination takes place in connectors that are pre-loaded with contacts. Thus the handling damage which can result when contacts and housings are separately supplied is greatly reduced. Also problems which can result in improper loading of contacts can be substantially eliminated.

Many of the mass terminated connectors on the market today have evolved to satisfy specific termination requirements for particular types of cables such as ribbon cable, jacketed cable, etc. Conversely cable structures were developed to capitalize on termination advantages of specific connectors. As a result many connectors tend to favor specific cable types. As some of the mass termination systems evolved, many of the advantages such as reliability, repairability, stackability, etc., of their crimp snap counter parts were sacrificed in favor of the benefits of mass termination. The present invention overcomes the difficulties of the prior art by providing the necessary flexibility to have the most favorable advantages of mass termination as well as the flexibility to accommodate different styles, types, and sizes of cables.

SUMMARY OF THE INVENTION

The present invention relates to a modular interconnect system having the advantages of mass termination and the flexibility of choice of cable, style, type and number of conductors. The subject interconnect system includes a plurality of substantially identical connector modules each having a mating face and at least one row of contact channels extending from the mating face and connected thereto by a bore, and a pair of cover members adapted to receive the plurality of modules therebetween in side by side relationship and to enclose the contact channels thereof. Each of the modules is provided with a plurality of contacts each having a mating portion directed towards the mating face and a termination portion lying within the contact channel and being suitable for mass termination.

It is therefore an object of the present invention to produce an improved modular interconnect system which will accommodate modules terminating cables of a wide variety of styles and types.

It is another object of the present invention to produce an interconnect system which will terminate cables such as discrete wire, jacketed cable, ribbon cable, twisted flat and woven twisted pair by having each type of cable terminated in a separate module and the modules gathered within a single housing.

It is another object of the present invention to produce a system which will accommodate a broad size range of solid or stranded conductors by terminating each size range and type of conductor in an appropriately sized module and to gather the modules together in a single housing.

It is another object of the present invention to produce a modular interconnect system which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
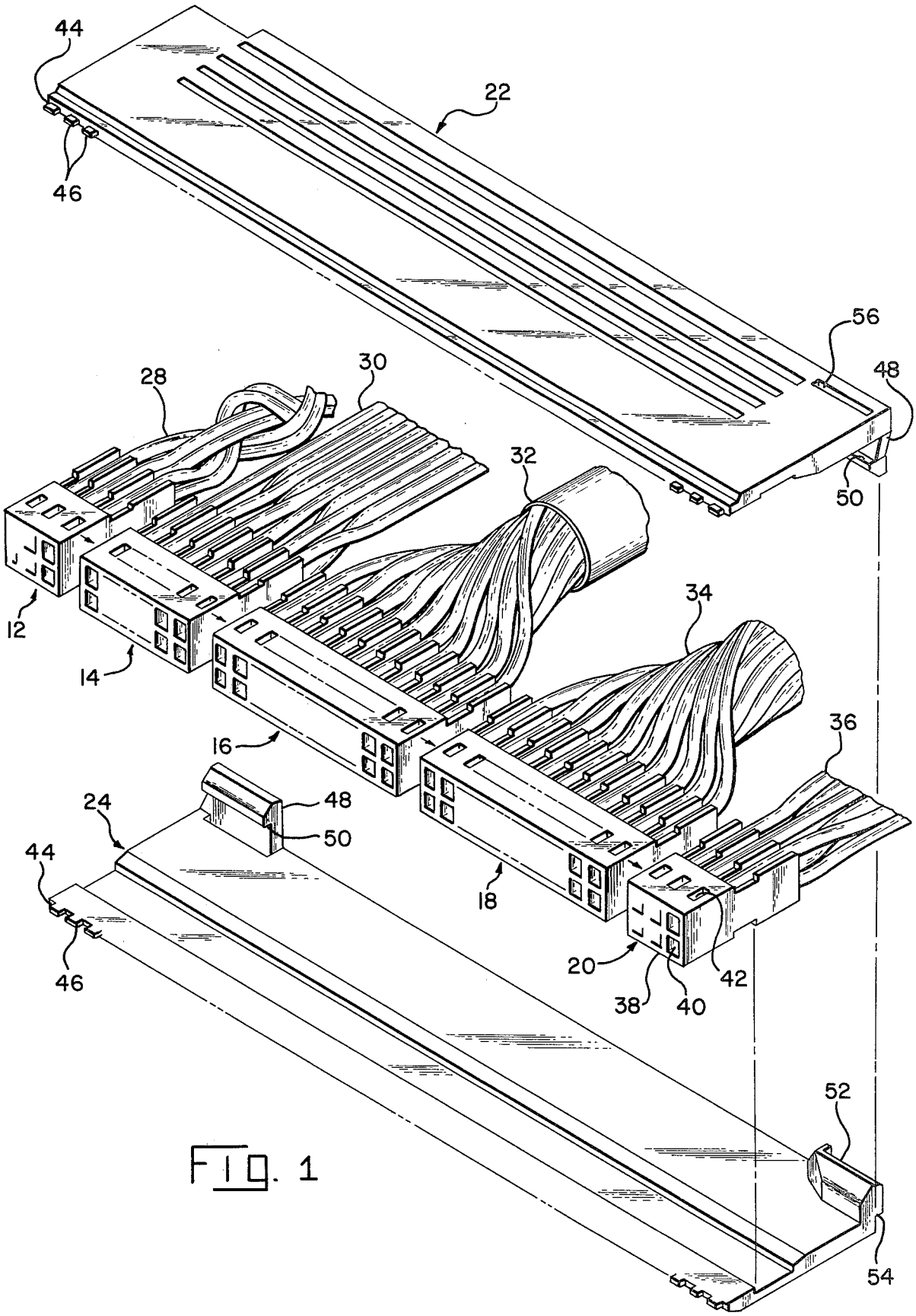
FIG. 1 is an exploded perspective view of a modular interconnect system according to the present invention.
Figure 2:
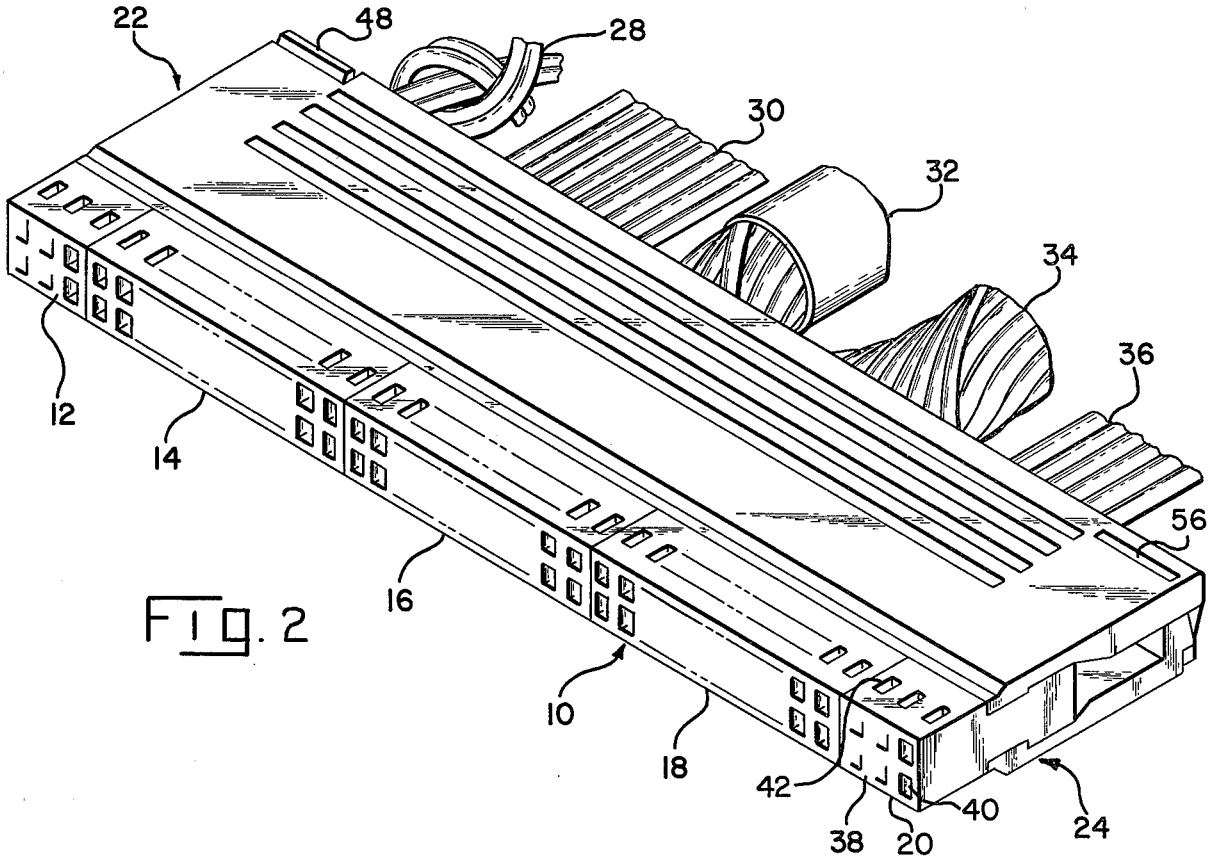
FIG. 2 is a perspective view of the assembled modular interconnect system according to the present invention.
Figure 3:
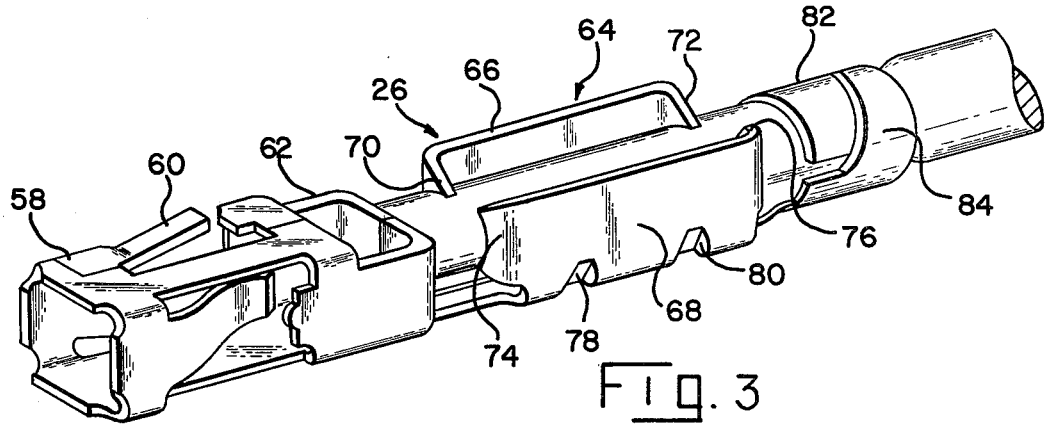
FIG. 3 is a perspective view of a terminal of the type used in the present invention.
Figure 4:
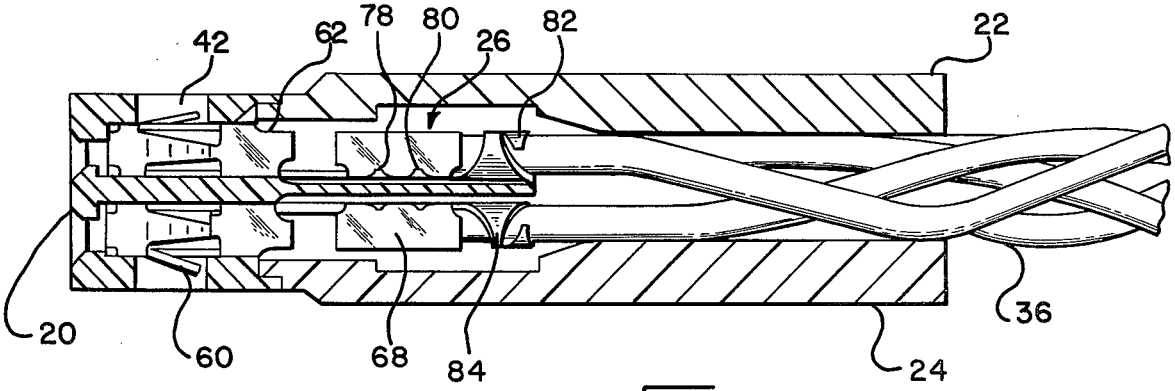
FIG. 4 is a transverse section through the assembly of FIG. 2.

The subject modular connector assembly 10 includes a plurality of substantially identical modules 12, 14, 16, 18, 20 received within upper and lower cover members 22, 24. Each module includes a plurality of contacts 26 and is used to terminate a respective cable 28, 30, 32, 34, 36. It should here be noted that the only difference between the modules is the size in the number of contacts and conductors it can handle. It should also be noted that the subject terminal can be used to terminate cables of all type such as discrete wire 34, jacketed cable 32, ribbon cable 30, twisted pair cable 28, flat cable, and woven twisted pair cable and that the system can be used to cover a wide size range of solid or stranded conductors from, for example, 30 gauge to 20 gauge wire and that the insulation displacement crimp of the contacts can accept all kinds of insulation such as PVC, irradiated PVC, TEFLON, TEFZEL, or KYNAR insulation.

Each module is an elongated member of rigid plastic material having a mating face 38 with a plurality of terminal passages 40 opening therein in at least one row. The sides of the module are open toward the rear so that the passages 40 are enclosed at their forward ends and are channel-shaped opening outwardly at their rear ends. The housing is also provided with a plurality of apertures 42 each aligned with a respective passage and spaced rearwardly of the mating face 38.

Each cover member 22, 24 has a module engaging front edge 44 including a plurality of tines 46 each aligned to be received within a respective passage 40. The cover further includes a depending latch leg 48 having a shoulder 50 directed towards the housing engaging portion 44 and on the opposite rear corner an upwardly extending portion 52 defining a rearwardly directed shoulder 54. A slot 56 is formed in the cover immediately in front of a portion of the latching leg 48.

Each terminal 26 includes a forward mating end 58 which is here shown as a pin receptacle of the type described in U.S. Pat. No. 3,363,224, the disclosure of which is incorporated herein by reference. This receptacle portion includes an outwardly directing locking lance 60 and a rear closure or post stop 62 which serves both to limit penetration of a mating pin terminal (not shown) into the receptacle as well as penetration of the conductor into the receptacle. The terminal further includes an insulation displacing rear portion 64 formed by a pair of upstanding walls 66, 68 defining a channel therebetween. Each end of each wall has an inwardly directed end portion 70, 72, 74, 76 with the opposing pairs of end portions defining insulation piercing slots therebetween. Each sidewall is provided with indents 78, 80 which provides strength to the sidewalls during the terminating operation. The terminal is completed by a pair of conductor engaging strain relief ears 82, 84.

The subject modules 12, 14, 16, 18, 20 are pre-loaded with a plurality of terminals 26 with each terminal having a forward mating end 58 extending into the respective passage 40 to lie adjacent the mating face 38. The aperture 42 receives the locking lance 60 of the terminal to secure it in place. In this position the channel shaped rear portion 64 of the terminal is exposed in the rear area of each passage. Each conductor of the respective cable can be laid into the appropriate passageway and terminated by a low force applied to the conductor to drive it into the slots defined by the inturned end portions 70, 72, 74, 76. This action will effect an insulation piercing of the conductor to make an electrical and mechanical engagement therewith. This termination action is accompanied by application of a die or like tool (not shown) to the crimp ears 82, 84 around the insulated portion of the conductor to secure it in place. This crimping force is far less than would be necessary to effect a normal F crimp or the like.

The terminated modules are gathered in the desired configuration and laid on one of the housing cover members 22, 24 so that the tines 46 thereof will be insertable into the terminal passages 40. The mating cover member is then applied to the opposite side of the modules and, since the cover members are hermaphroditic, there is no problem in pairing or aligning them for closure. The assembly is completed by merely snapping the cover members together.

It will be appreciated from the foregoing that the subject modular interconnect system allows the individual modules to terminate any of a variety of cables. Thus the completed assembly can be used to interconnect cables of a wide variety of types, numbers, and configurations to make a single compatible connector.

The present invention may be subject to many modifications and changes without departing from the spirit or essential characteristics thereof. The present embodiment should therefore be considered in all respects as illustrative and not restrictive of the scope of the invention.

What is claimed is:

1. A modular electrical connector assembly comprising:

a plurality of housing modules each having a plurality of terminal passages extending from a rear end through said housing module to open on a front mating face, each said passageway being fully enclosed at the mating face and forming an outwardly directed open channel shape at the rear end remote from said mating face;

a plurality of terminals each mounted in a respective one of said passageways, each said terminal having a forwardly directed mating portion lying in said fully enclosed portion of said passageway and an insulation displacing rear portion lying in and accessible from said rear channel shaped portion; and a pair of hermaphroditic cover members each having a forward end receivable in said enclosed portions of said passageways and intermating rear latching portions, said cover members being of sufficient size to engage and enclose the rear ends of all of said plurality of modules, whereby each module is used to terminate a specific cable and an assembly of modules is enclosed in a single pair of covers to form an integral connector unit of cables of different sizes and types.

2. A connector assembly according to claim 1 wherein said modules have different numbers of terminal passages whereby cables with different numbers of conductors are accommodated.

3. A connector assembly according to claim 1 wherein said terminals are adapted to receive conductors of different sizes with only a single size terminal being in each module whereby cables with different size conductors are accommodated in separate modules.

4. A method of terminating a plurality of cables of diverse types in a single connector comprising:

providing a plurality of housing modules, one per cable, each having a plurality of terminal passages extending from a rear end through said housing to open on a front mating face, each said passageway being fully enclosed at the mating face and forming an outwardly directed open channel shape at the rear end remote from said mating face;

providing a plurality of terminals each mounted in a respective one of said passageways, each said terminal having a forwardly directed mating portion lying in said fully enclosed portions of said passageway and an insulation displacing rear portion lying in and accessible from said rear channel shaped portion; and providing a pair of hermaphroditic cover members each having a forward end receivable in said enclosed portions of said passageways and intermating rear latching portions, said cover members being of sufficient size to engage and enclose all of said plurality of modules, whereby each module can be used to terminate a cable of a specific size and type and the assembly of modules can be enclosed in said pair of covers to form an integral connector unit of cables of different sizes and types.

5. The method according to claim 4 wherein the terminals of each module are capable of handling conductors of a specific size whereby a different module handles each cable having conductors of a different size.

6. The method according to claim 4 wherein each module carries a different number of terminals whereby cables with different numbers of conductors may be accommodated.

* * * * *